United States Patent [19]

Mima

[11] 4,312,133

[45] Jan. 26, 1982

[54] T-SQUARE

[75] Inventor: Rikichi Mima, Ikoma, Japan

[73] Assignee: Miwa Gomu Kogyo Kabushikikaisha, Osaka, Japan

[21] Appl. No.: 147,005

[22] Filed: May 6, 1980

[30] Foreign Application Priority Data

May 22, 1979 [JP] Japan ..... 69174[U]
May 22, 1979 [JP] Japan ..... 69175[U]

[51] Int. Cl.[3] ..... B43L 7/06

[52] U.S. Cl. ..... 33/468; 33/492; 33/493

[58] Field of Search ..... 33/433, 468, 469, 479, 33/492, 493

[56] References Cited

U.S. PATENT DOCUMENTS

| | | | |
|---|---|---|---|
| 757,675 | 4/1904 | Peucker | 33/493 |
| 794,569 | 7/1905 | Thomas | 33/468 |
| 798,721 | 9/1905 | Wilson | 33/468 |
| 1,173,341 | 2/1916 | Cotton | 33/469 |
| 2,127,617 | 8/1938 | Petree | 33/492 |

FOREIGN PATENT DOCUMENTS

| | | | |
|---|---|---|---|
| 835418 | 2/1952 | Fed. Rep. of Germany | 33/492 |
| 1252383 | 12/1960 | France | 33/492 |

*Primary Examiner*—Charles E. Phillips
*Attorney, Agent, or Firm*—Jordan and Hamburg

[57] ABSTRACT

A T-square useful for drawing lines and cutting paper or plastic sheets comprises a ruler main body of a plastic material and an auxiliary ruler section detachably and turnably connected to an end of the main body by threaded fastening members, one of the opposed surfaces of the main body and the auxiliary ruler section adjacent to where they are connected being provided with a number of retaining bores arranged in a circular pattern about the threaded connection, the other opposed surface being provided with at least one retaining projection engageable in any one of the retaining bores, whereby the angle between the ruler main body and the auxiliary ruler is adjustingly variable. A metallic edge member covers a side edge of the main body to prevent a cutting knife from bitting into the plastic material of the ruler main body. The edge member is attached to the ruler main body at the longitudinal midportion thereof, the difference in the degree of thermal expansion or contraction between the ruler main body and the edge member thereby being accommodated.

1 Claim, 10 Drawing Figures

1
2
3
11
12
13
14
15
16
17
17'
18
18'
21
22
23
24
31
32
33
41
42
43
44

T-SQUARE

BACKGROUND OF THE INVENTION

This invention relates to a T square useful for drawing parallel lines or lines at various angles and for cutting sheets for drawing and paper ware applications.

T-squares heretofore used for drawing and paper ware application generally comprise a ruler main body and an auxiliary ruler section which are fixedly joined to each other at right angles, so that when the T square is used solely for drawing parallel lines with the auxiliary ruler section in abutting contact with a side edge of a drawing board, the square is adapted to rule horizontal or vertical lines only. The T square therefore requires the use of a set of right angles in combination therewith for drawing oblique lines which is cumbersome to use. Such a combination further involves difficulties in drawing lines at the desired angle since the angle at which lines can be ruled is limited by the particular right angles available. While T-squares of the type described are usually made of plastic materials, plastics T-squares involve another difficulty. When a knife is slid along the edge of the ruler main body in the cutting of paper, plastics or like sheets, the knife is likely to bite into the edge causing damage to the ruler main body so that it is no longer usable smoothly. When repeatedly used in this way, the T-square will be seriously damaged at the edge portion and become unserviceable.

SUMMARY OF THE INVENTION

An object of the present invention, which has been accomplished to overcome the above drawbacks, is to provide a T-square which is usable in the same manner as conventional T-squares and in which the ruler main body and the auxiliary ruler section are releasably connectable at a freely variable angle. The T-square can be used in making angular lines, parallel lines or in establishing cutting lines at the desired angle of inclination, the ruler main body and the auxiliary ruler section further being separable for use individually, the T-square thus having greatly increased usefulness.

Another object of the invention is to provide a T-square which comprises a plastics ruler main body and a metallic edge member covering a side edge of the ruler main body and which is made smoothly usable for cutting by preventing a knife edge from biting into the edge portion to cause damage thereto.

Still another object of the invention is to provide a T-square which comprises a plastics ruler main body and a metallic edge member attached to a side edge of the main body in such manner that differences in the degree of thermal expansion or contraction between the ruler main body and the edge member can be absorbed at the attaching portion so that the T-square can be used satisfactorily for a prolonged period of time free of marked deflection of the main body or without inadvertent removal of the edge member from the ruler main body even when subjected to varying temperatures from season to season that would thermally expand or contract the main body greatly.

BRIEF DESCRIPTION OF THE DRAWINGS

Other objects and advantages of the invention will become apparent from the following description of embodiments with reference to the accompanying drawings, in which.

DESCRIPTION OF THE PREFERRED EMBODIMENTS

Figures 1, 3:
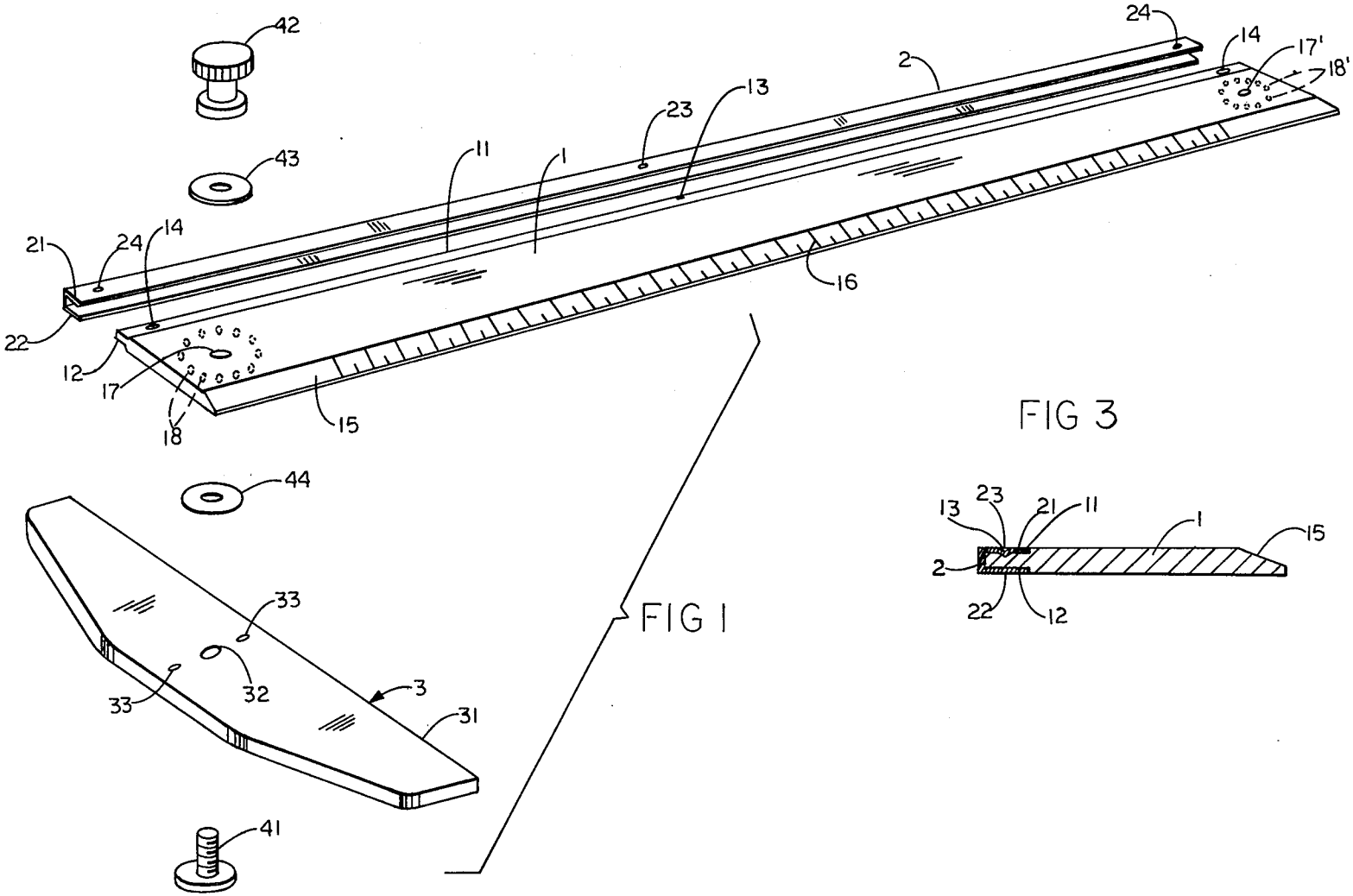
FIG. 1 is an exploded perspective view showing a T-square of the invention in its entirety.
FIG. 3 is an enlarged view in section taken along the line III—III in FIG. 2.
Figure 2:
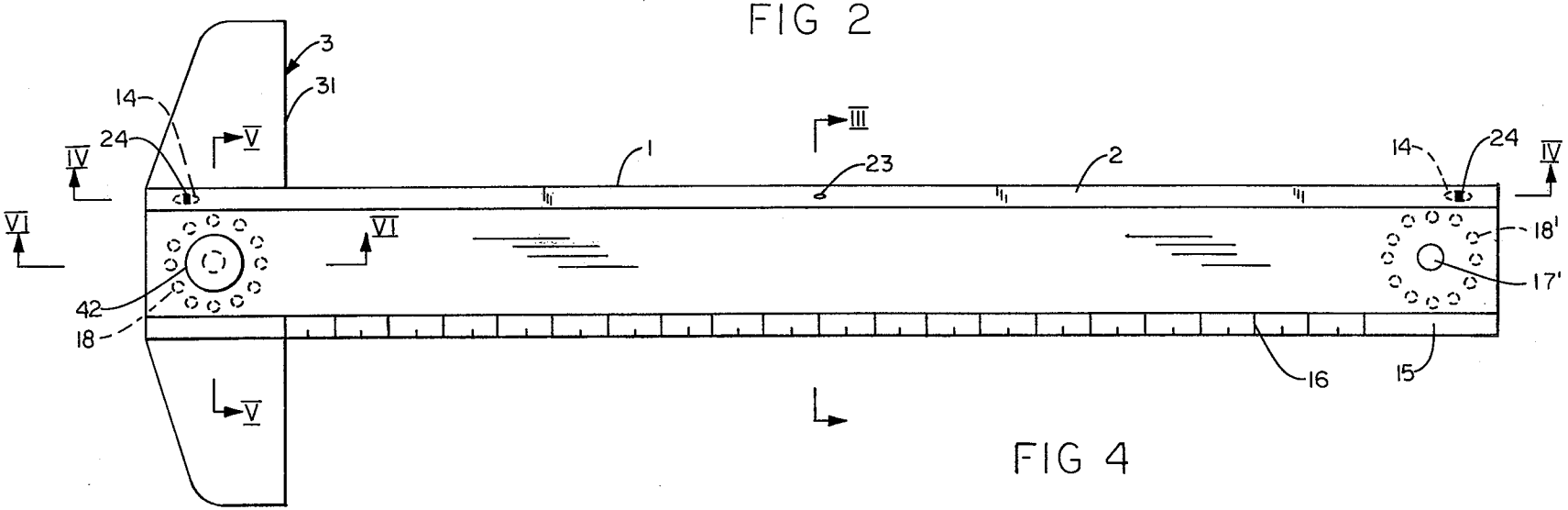
FIG. 2 is a plan view showing the T-square in its assembled state.
Figure 4:
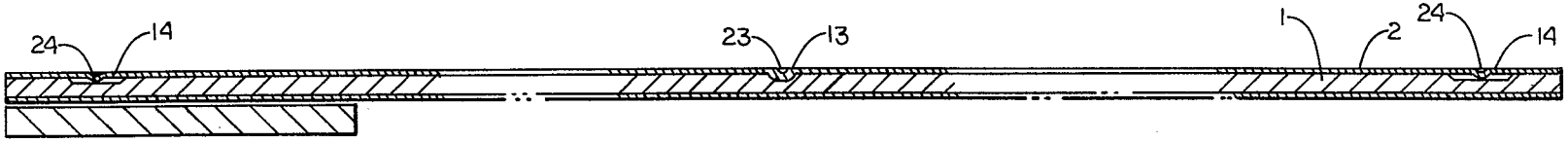
FIG. 4 is an enlarged view in section taken along the line IV—IV in FIG. 2.
Figure 6:
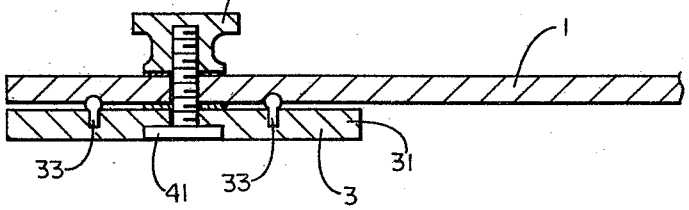
FIG. 6 is an enlarged view in section taken along the line VI—VI in FIG. 2.
Figure 5:
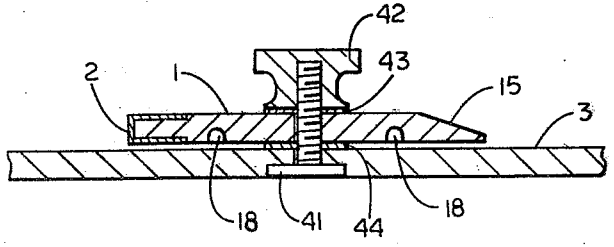
FIG. 5 is an enlarged view in section taken along the line V—V in FIG. 2.

With reference to FIGS. 1 to 6, a T-square comprises a ruler main body 1, a metallic edge member 2 covering a side edge of the main body 1, and an auxiliary ruler section 3. The ruler main body 1 is in the form of a strip of uniform width and is made of transparent or semi-transparent acrylic or like plastics material. The main body 1 has stepped portions 11 and 12 on the upper and lower sides of the edge to which the edge member 2 is to be attached. The edge member 2 is made from a plate of metal, such as stainless steel, in the form of a channel, covers the stepped side edge of the main body 1 and is fixedly attachable thereto locally at its longitudinal midportion. At locations spaced from the attached midportion by a predetermined specific distance on longitudinally opposite sides thereof, the edge member is also attachable to the main body loosely longitudinally thereof by the interengagement of projections in longitudinally elongated cavities. Stated more specifically, a small circular bore 13 is formed at the longitudinal midportion of the main body 1 in the surface of the upper stepped portion of the edge, and longitudinally elongated cavities 14, 14 are formed in the same surface close to both ends of the body. The edge member 2 is formed, at the longitudinal midportion of its upper leg 21 and at locations close to both ends thereof, with projections 23 and 24, 24 respectively. Such projections extend inwardly and are positioned longitudinally along leg 21 in corresponding relation to the bore 13 and the cavities 14, 14.

The ruler main body 1 is provided along the other side edge thereof with a scale 16 on its upper surface which slopes downwardly slanting to present a upper surface 15 extending the entire length of the body 1.

At both ends (or one end), the main body at 1 has holes 17, 17′ extending therethrough for joining the auxiliary ruler section 3 to the ruler main body. Retaining bores 18, . . . , 18′, . . . spaced apart by a predetermined distance extend in a circular arrangement around the respective holes 17, 17′ in the lower surface of the main body.

The auxiliary ruler 3 is in the form of a plate made of the same material as the main body 1 and is provided with a center hole 32 extending therethrough for attaching the ruler 3 to the main body 1 and with a straight side edge 31. One or several (two, in the illustrated embodiment) retaining projections 33, 33 are formed around the hole 32 on the upper surface of the auxiliary ruler. The projections 33, 33 may be molded integrally with the auxiliary ruler 3, but it is preferable to form them by inserting metal pins therein. FIG. 1 also shows a connecting screw member 41, a connecting internally threaded member 42 and washers 43, 44.

The metallic edge member 2 is attached to the main body 1 by fitting the edge member 2 to the side edge thereof with the upper and lower legs 21, 22 in elastic engagement with the stepped portions 11, 12 and with the upper and lower surfaces of the member 2 flush with the adjacent surfaces of the main body 1 such that projections 23, 24, 24 engage respectively in the bore 13 and cavities 14, 14.

The ruler main body 1 is thereafter superposed at one end on the auxiliary ruler 3 with the retaining projections 33, 33 engaged in the desired bores 18, 18. The body 1 and the ruler 3 are then fastened together in a T-form at the aligned holes 32 and 17 by threaded connection of the screw member 41 and the internally threaded member 42 to provide a T-square.

Figure 8:
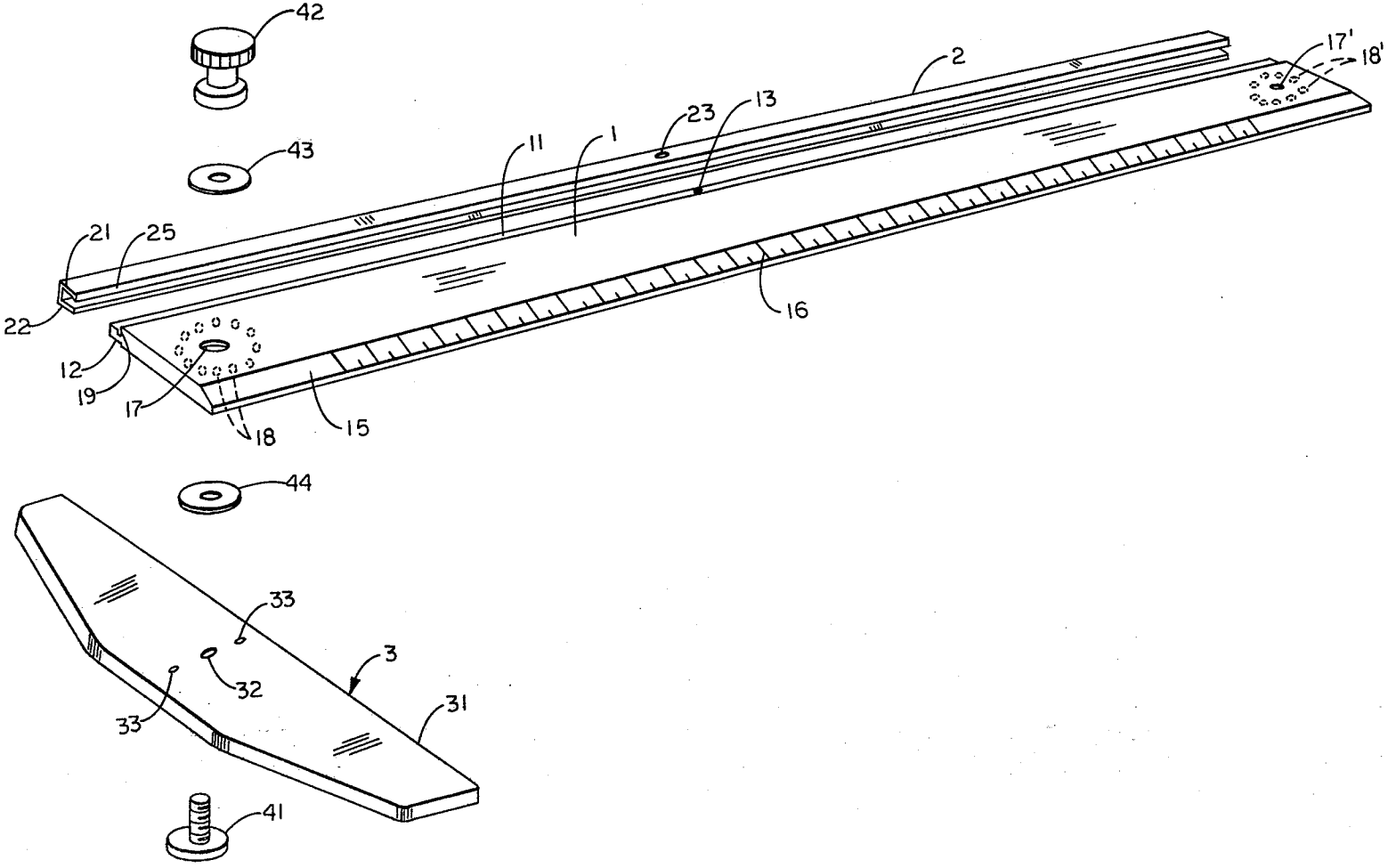
FIG. 8 is an exploded perspective view showing another embodiment which differs from the first embodiment in the structure for attaching a metallic edge member to the ruler main body of the square.
Figure 9:
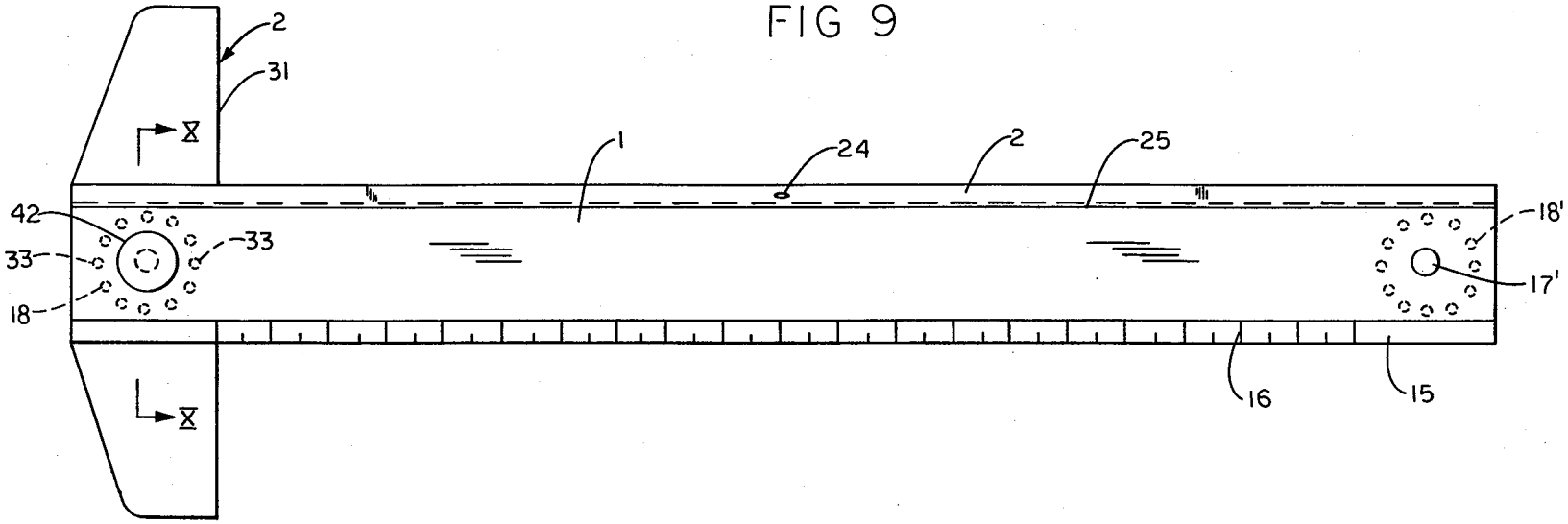
FIG. 9 is a plan view showing the embodiment of FIG. 8 in its assembled state.
Figure 10:
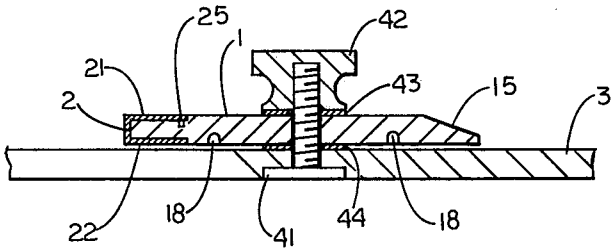
FIG. 10 is a view in section taken along the line X—X in FIG. 9.

FIGS. 8 and 10 show another embodiment of the invention in which the metallic edge member 2 is attached to the ruler main body 1 by a different structure. With reference to these figures, the main body 1 has a small circular bore 13 at the longitudinal midportion thereof in an upper stepped portion of its one side edge. A groove 19 is formed at the inner edge of the stepped portion 11 and extends over the entire length of the body 1. The metallic edge member 2 includes an upper leg 21 having an inward projection 23 at the longitudinal midportion thereof. The forward edge of the upper leg 21 is bent upwardly to provide an engaging flange element 25. The edge member 2 is attached to the main body 1 by being fitted over the side edge of the body 1 to engage the upper and lower legs 21, 22 of the member 2 with the stepped portions 11, 12 the flange element 25 being engaged in the groove 19 and further with the projection 23 engaged in the bore 13. For this procedure, the legs of the edge member 2 may be engaged with the stepped portions and groove of the main body 1 by longitudinal sliding movement, or by spreading apart the legs 21, 22 and fitting the edge member 2 in a slightly opened state over the side edge of the main body 1 from outside sidewise, thereafter pressing the upper and lower legs 21, 22 toward each other to attach the edge member 2 in place by engagement. The second embodiment basically has the same construction as the embodiment of FIGS. 1 to 6 with the exception of the structure for attaching the member 2 to the main body 1. Throughout the accompanying drawings, therefore, like parts are referred to by like reference numerals. Although the ruler main body 1 of the second embodiment illustrated has upper and lower stepped portions 11, 12 on both sides of its side edge, the lower side alone may be provided with the stepped portion 12 such that the upper leg 21 of the edge member 2 may cover the upper side in a stepped manner. In this case, the bore 13 and the groove 19 are formed in the upper side of the edge of the main body 1 in a specified arrangement in corresponding relation to those formed in the upper stepped portion 11. Similarly the first embodiment can be provided with the stepped portion 12 only on the lower side of the edge of the ruler main body 1.

The T-squares embodying the present invention as described above will be used in the following manner.

For use in cutting paper, plastics or like sheets, the square is placed on the sheet, and a knife is slidingly moved along the edge of the metallic edge member 2 which has been attached to one side edge of the ruler main body 1. The knife is smoothly slidable along the metallic edge member 2 without biting into the member and causing damage to the edge of the square, whereby the sheet is neatly cuttable in a straight line and with accuracy without producing any interruption in the cut line.

Figure 7:
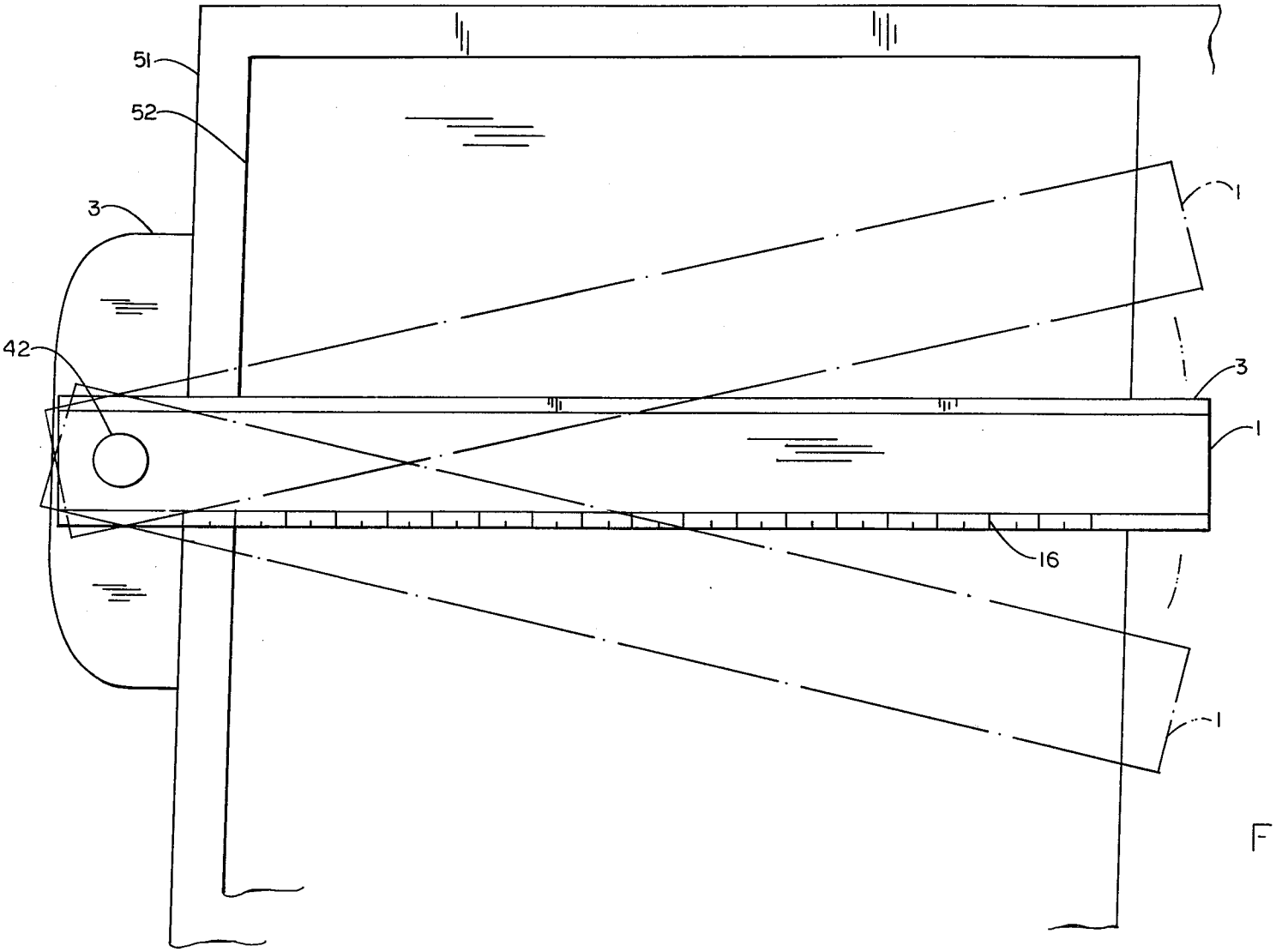
FIG. 7 is a plan view showing the T-square in use.

In this case, the square can be used with its ruler main body 1 connected to the auxiliary ruler 3 in a T-form, in the same manner as the usual T-square, by sliding the side edge 31 of the auxiliary ruler section 3 along the left side edge or upper side edge of a cutting mat or drawing board 51 to move thereby the main body 1 and form horizontal or vertical cut lines in a sheet 52 (see FIG. 7).

When the side edge provided with scale 16 is used, the square can be used as a usual drawing T-square. In this case, the square is convenient to use if the auxiliary ruler section 3 is attached to the right end of the ruler main body shown. Further, the square is usable with the auxiliary ruler section 3 attached to the left end or right end of the main body 1 in accordance with whether the user is right-handed or left-handed.

Furthermore, the square is usable for the cutting or drawing of lines at the desired angle of inclination when used with the angle of connection between the main body 1 and the auxiliary ruler section 3 as indicated by phantom lines in FIG. 7. The angle of connection can be altered by loosening the threaded members 41, 42 to disengage the projections 33, 33 from the bores 18, 18, turning the main body 1 through the desired angle relative to the auxiliary ruler section 3, and then tightening up members 41, 42 again with the projections 33, 33 engaged in bores 18, 18 in suitable different positions. With the main body 1 thus attached to the auxiliary ruler 3, the main body 1 is effectively retained in position against relative rotation and firmly held to the ruler section 3 by the fastening force of threaded members 41, 42 and also by the engagement of the projections 33, 33 in the bores 18, 18. The square is usable for cutting or drawing parallel lines or lines at the desired angle.

When desired, the threaded members 41, 42 are removed to separate the main body 1 from the auxiliary ruler 3 so that the main body 1 can be utilized by itself as a ruler.

With the T-square described above, the ruler main body 1 is made of plastics while the edge member 2 is metallic, so that one differs from the other greatly in thermal expansion coefficient. Normally if the edge member 2 is bonded entirely to the ruler main body 1 with adhesive, one side edge of the main body 1 will be restrained from expansion or contraction by the edge member 2 but the other side edge thereof will be free to greatly expand or contract, when the main body 1 is subjected to varying temperatures, for example, due to changes of seasons. This results in marked deflection of the main body 1. Additionally the joint between the edge member 2 and the main body 1 will be subjected to great stress due to the longitudinal thermal expansion or contraction of the main body 1, possibly leading to the separation of the edge member 2. Consequently the T-square will have poor durability and its utility will be impaired.

According to the present invention, however, the edge member 2 is fixedly attached to the main body 1 only at the longitudinal midportion as already stated, rendering the main body 1 and the edge member 2 free to expand or contract longitudinally thereof without interfering with each other. Stated more specifically, the projections 24, 24 positioned close to the longitudinal ends are engaged in the elongated cavities 14, 14 according to the first embodiment, or the engaging flange element 25 of the edge member 2 is engaged in the groove 19 over the entire length of the main body 1 according to the second embodiment, whereby the main body 1 and the edge member 2 are allowed to expand or contract independently of each other while the edge member 2 is effectively prevented from deformation or sidewise separation from the main body 1. As a result, the main body 1 is unlikely to deflect, and the portion of the edge member 2 where it is attached to the main body 1 is free of any longitudinal stress. This gives the square improved durability, rendering the square serviceability as contemplated.

In addition to the foregoing embodiments, the T-square of the invention can be modified in various ways. For example, an edge member 2 may be attached to each of the opposite side edges of the ruler main body 1. The lower surfaces of the main body 1 and the edge member 2 may be in a stepped arrangement, such that when the main body 1 is placed on a sheet for use, a suitable clearance will be formed between the lower surface of the edge member 2 and the sheet surface. The lower surfaces of the main body 1 and the edge member 2 may be made substantially flush with each other, with minute projections or indentations formed on the lower surface of the edge member 2 to prevent slippage. The edge member 2 may have a scale marked on its upper surface. The main body 1 may be marked on its upper or lower surface with a cross or with some other suitable pattern, scale or lines so as to be convenient for use as a ruler.

As means for connecting the main body 1 and the ruler 3 together at a variable angle, the auxiliary ruler section 3 may be formed with a number of retaining bores in a circular arrangement, with cooperable retaining projections provided on the main body 1, in reverse relation to the illustrated embodiments.

According to the invention described above, the angle of connection between the ruler main body 1 and the auxiliary ruler section 3 is suitably adjustable or variable. With the auxiliary ruler section held in contact with a side edge of a drawing board or cutting mat, the square of the invention is therefore usable not only for making lines, parallel lines or cut lines in a horizontal or vertical direction like usual T-squares but also for cutting or drawing lines at the desired angle of inclination. Moreover the angle is variable simply by loosening and tightening up the threaded members. The main body 1 can be firmly held in fixed relationship with the auxiliary ruler section 3 without any play or backlash during use by the fastening force of the threaded members and also by the engagement of the retaining projections in the retaining bores. When desired, the ruler main body is usable when separated from the auxiliary ruler section. The metallic edge member covering the side edge of the main body serves to reinforce the main body and enables a cutting knife to cut a sheet very smoothly and neatly along the edge member without allowing the knife to bite into the main body edge with consequent production of a discontinuous cut line. Especially because the metallic edge member is fixedly attached to the main body only at the longitudinal midportion while it is loosely engaged therewith at other longitudinal portions, the main body will not undergo marked deflection or the edge member is unlikely to inadvertently separate from the main body, even when the main body markedly expands or contracts by being subjected to variations in temperature due to changes of seasons. The T-square therefore has a greatly prolonged life. With these various advantages, the T-square of the present invention is highly useful.

What is claimed is:

1. A T-square comprising an elongated ruler main body formed of a plastic material and having a pair of opposed side edges, an auxiliary ruler section having at least one straight edge, connecting means for releasably connecting said auxiliary ruler section to said ruler main body at one end thereof such that at least one of the side edges of said ruler main body extends in selected angular relationship to said straight edge of said auxiliary ruler section, means defining an aperture formed in at least one end of said ruler main body and a corresponding alignable aperture formed in substantially the mid-point of said auxiliary ruler section, said connecting means comprising a pair of cooperable threaded elements at least one of which is insertable into said apertures, said threaded elements being cooperable to releasably secure the ruler main body and the auxiliary ruler section in said selected angular relationship, said threaded elements being constructed to be loosened such that said ruler main body and said auxiliary ruler section can be rotated relative to each other to establish said angular relationship therebetween, one of the opposed surfaces of said ruler main body and auxiliary ruler section being provided with a series of circumferentially spaced retaining bores arranged concentrically about the aperture therein and the other of said opposed surfaces being provided with at least one projection member insertable within an aligned one of said retaining bores, an elongated metallic edge member attachable to said ruler main body so as to cover at least one of the side edges thereof, said edge member being secured to said ruler main body at the longitudinal mid-point thereof, a projection on one of said ruler main body and metallic edge member and a bore in the other, said bore being dimensioned to receive said projection and thereby secure said edge member to said ruler main body at the mid-point thereof, longitudinally elongated cavities formed in said ruler main body at a plurality of locations thereon spaced from said longitudinal mid-point thereof and corresponding projections formed on said edge member, said elongated cavities providing for uneven expansion between said plastic ruler main body and said metallic edge member, one of said cavities being formed in said ruler main body adjacent each of the opposed ends thereof, said metallic edge member being an elongated channel member having a pair of opposed legs, the spacing between said legs being selected such that when said edge member is secured to said ruler main body said legs cover the opposed surfaces of said one side edge, said one side edge being given a reduced thickness relative to the adjacent surfaces of the ruler main body so that when the edge member is secured thereto the outer surfaces of the channel legs will be flush with the adjacent surfaces of the ruler main body.

* * * * *